US005194857A

United States Patent [19]

Gomez

[11] Patent Number: 5,194,857

[45] Date of Patent: Mar. 16, 1993

[54] PAGER WITH RECHARGEABLE BATTERY AND METHOD FOR CHARGING SAME

[75] Inventor: Fernando A. Gomez, West Palm Beach, Fla.

[73] Assignee: Motorola, Inc., Schaumburg, Ill.

[21] Appl. No.: 734,715

[22] Filed: Jul. 23, 1991

[51] Int. Cl.[5] ..... G08B 5/22; H04B 1/18; H01Q 1/12; H01Q 1/44

[52] U.S. Cl. ..... 340/825.44; 340/825.48; 343/718; 343/720; 455/343

[58] Field of Search ..... 340/825.44, 825.48, 340/825.54; 343/702, 718, 720; 455/38, 343, 344, 348, 349; 320/2; 363/159

[56] References Cited

U.S. PATENT DOCUMENTS

| | | | |
|---|---|---|---|
| 3,808,538 | 4/1974 | Goransson et al. | 340/825.48 |
| 4,044,292 | 8/1977 | Tomlin | 320/2 |
| 4,255,782 | 3/1981 | Joyce | 363/159 |
| 4,856,088 | 8/1989 | Oliwa et al. | 340/825.44 |
| 4,888,585 | 12/1989 | Kamiya et al. | 340/825.54 |
| 4,937,586 | 6/1990 | Stevens et al. | 340/825.54 |

*Primary Examiner*—Donald J. Yusko
*Assistant Examiner*—Andrew M. Hill
*Attorney, Agent, or Firm*—Philip P. Macnak; William E. Koch; Thomas G. Berry

[57] ABSTRACT

A wrist watch pager (100) powered by a rechargeable battery (234) comprises an antenna having first and second antenna portions (102A and 102B) for receiving paging signals when the first and second portions (102A and 102B) are coupled together to form a loop antenna. The first and second antenna portions (102A and 102B) receive a charging voltage from a battery charger (120) directly coupled to the first and second antenna portions (102A and 102B) when the first and second antenna portions (102A and 102B) are uncoupled thereby disabling the loop antenna. A receiver (204) coupled to the loop antenna presents an alert in response to the paging signals. A device (230) coupled between the loop antenna and the receiver (204) blocks the charging voltage from the receiver (204). Another device (232) coupled between the loop antenna antenna and the rechargeable battery (234) blocks the received paging signal from the battery charger (120).

5 Claims, 2 Drawing Sheets

PAGER WITH RECHARGEABLE BATTERY AND METHOD FOR CHARGING SAME

FIELD OF THE INVENTION

This invention relates in general to battery charging, and more specifically to a method of using a pager antenna for battery charging.

BACKGROUND OF THE INVENTION

Portable electronic devices typically employ small energy sources (e.g., rechargeable batteries) that must be recharged from time-to-time. Most portable battery chargers are large and heavy since they typically carry several energy cells to provide a sufficient charging current. Conversely, fixed (e.g., A.C.-D.C. type) battery chargers are not as convenient as portable (e.g., D.C.-D.C. type) battery chargers since they are tethered to an A.C. power source.

For a miniature portable device, such as a wrist watch pager (or selective call receiver in general), the reduction in size and unique design of the wrist watch pager reduce the accessible surface area for providing terminals to couple to the portable battery charger. This difficulty of providing terminals for battery charging generally results in the alternative use of non-rechargeable batteries instead of rechargeable batteries.

Unfortunately, contemporary battery current demands has caused a significantly reduction in battery-life, which exacts an undesirable cost increase to consumers, since non-rechargeable batteries must be purchased and replaced frequently.

Thus, what is needed is a wrist watch pager capable of being coupled to a battery charger for charging a rechargeable battery.

SUMMARY OF THE INVENTION

A selective call receiver powered by a rechargeable battery comprises an antenna having first and second antenna portions for receiving paging signals when the first and second portions are coupled together to form a loop antenna. The first and second antenna portions receive a charging voltage from a battery charger directly coupled to the first and second antenna portions when the first and second antenna portions are uncoupled thereby disabling the loop antenna. A receiver coupled to the loop antenna presents an alert in response to the paging signals. A device coupled between the loop antenna and the receiver blocks the charging voltage from the receiver. Another device coupled between the loop antenna and the rechargeable battery blocks the received paging signal from the battery charger.

DESCRIPTION OF A PREFERRED EMBODIMENT

Figure 1:
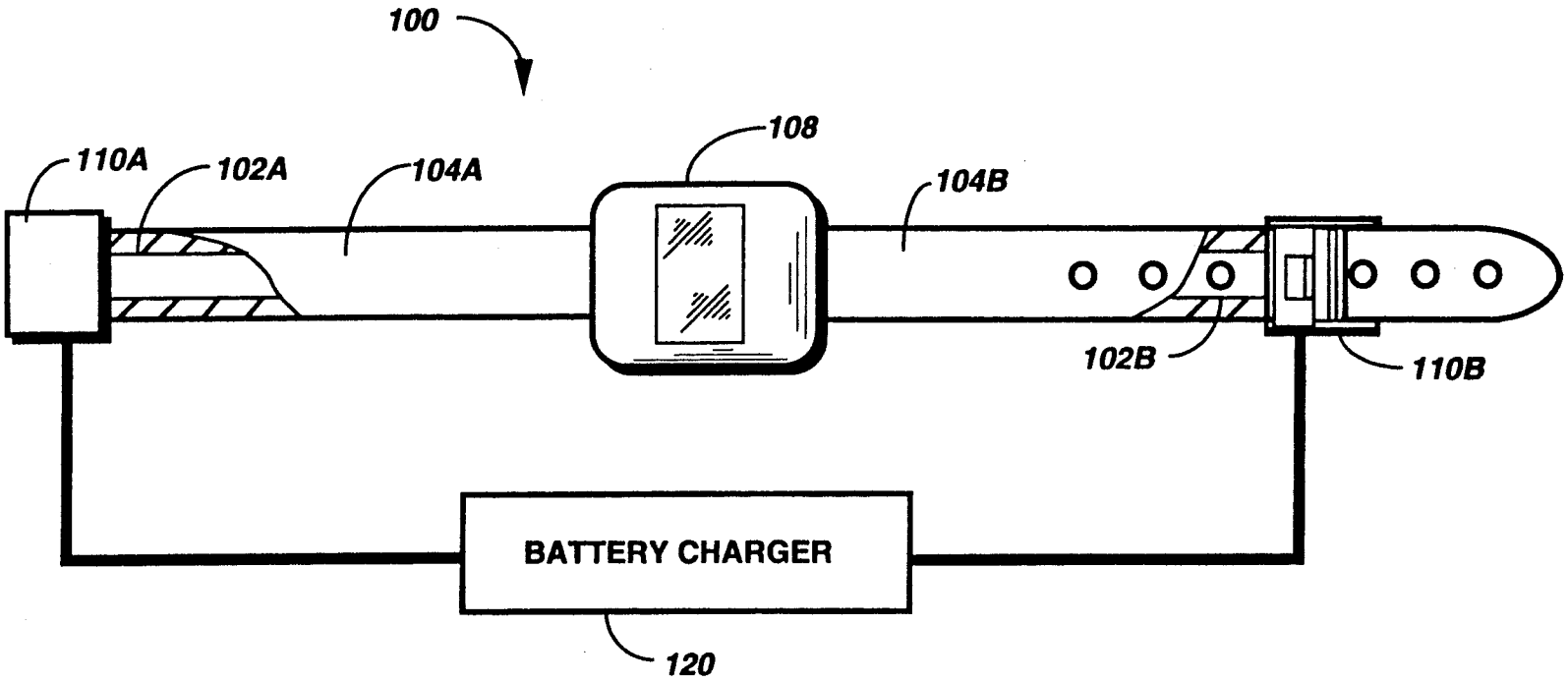
FIG. 1 is a block diagram of a wrist watch pager coupled to a battery charger in accordance with a preferred embodiment of the present invention.

Referring to FIG. 1, a wrist watch pager 100 comprises a housing 108 coupled to a wrist strap that is preferably in the form of a first wrist strap portion 104A and a second wrist strap portion 104B. The first wrist strap portion 104A has a first end coupled to the housing 108, and a second end coupled to a first clasp 110A. The second wrist strap portion 104B is similarly coupled to the housing 108 and a second clasp 110B. The first and second clasps 110A and 110B couple together to secure the wrist watch pager 100 to a user. The wrist strap forms a loop antenna having a first antenna portion 102A and second antenna portion 102B that are coupled to the first and second clasps 110A and 110B, respectively. The first and second portions of the antenna 102A and 102B are preferably disposed within the first and second wrist straps 104A and 104B, respectively, and forms a closed loop when the first and second clasps 110A and 110B are coupled together.

The wrist watch pager 100 is shown coupled to a battery charger 120 via the first and second clasps 110A and 110B which, in turn, are coupled to the first and second portions of the antenna 102A and 102B. Those skilled in the arts will appreciate that the battery charger 120 may be coupled to any exposed areas of the first and second antenna portions 102A and 102B. In this way, the wrist watch pager 100 uses the antenna 102A and 102B to couple to the battery charger 120. The antenna, in this fashion, is able to receive a charging voltage from the battery charger thereby, eliminating the need for additional terminals on the housing of the wrist watch pager to couple the battery charger to the wrist watch pager.

Figure 2:
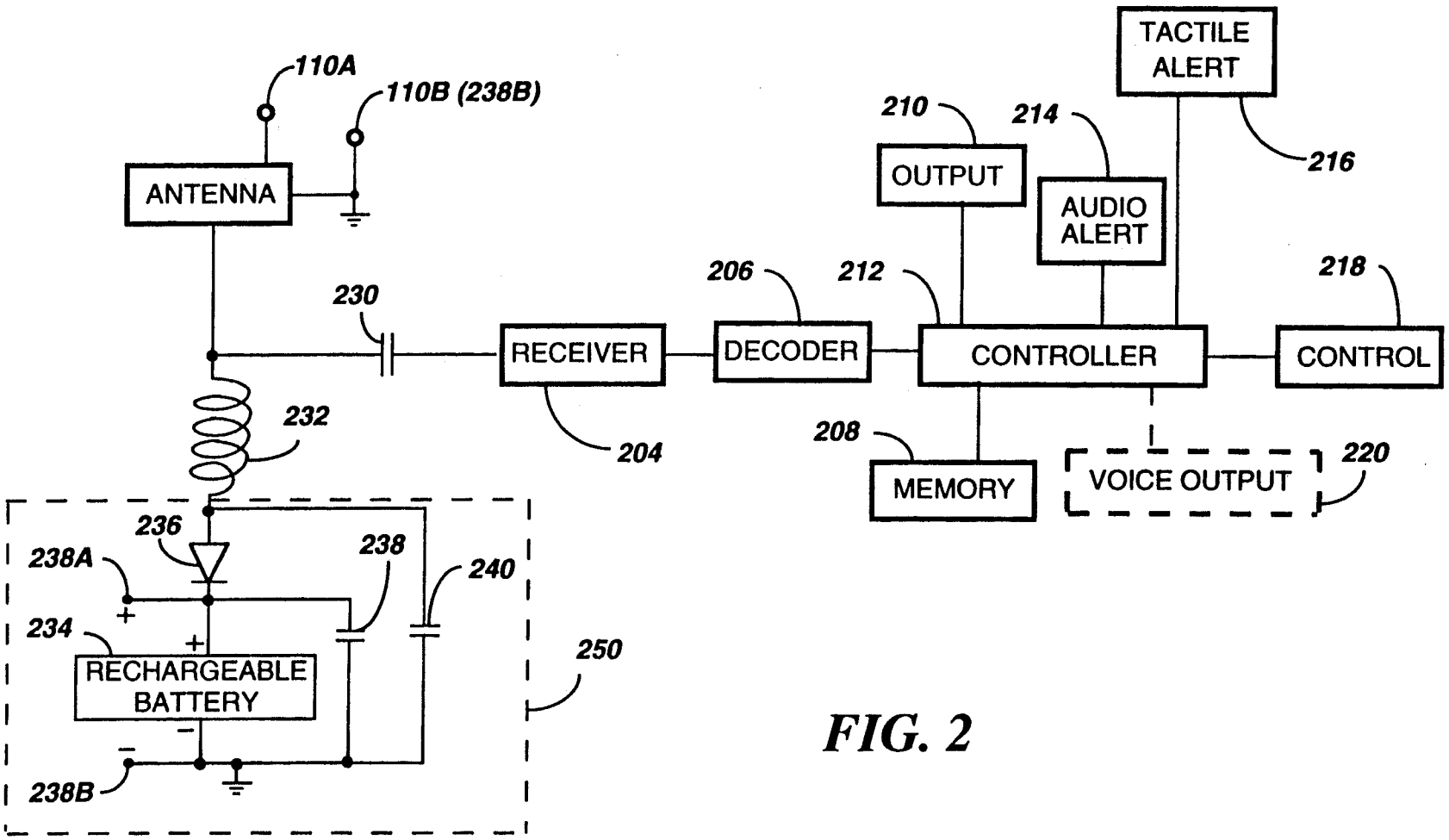
FIG. 2 is a detailed block diagram illustrating the operation the wrist watch pager of FIG. 1 according to the invention.

Referring to FIG. 2, a detailed block diagram illustrates the operation of wrist watch pager 100 contained within the housing 108. Those skilled in the arts will appreciate that the invention is also applicable to other types of selective call receivers. According to the invention, the wrist watch pager 100 comprises the antenna 102A and 102B that provides a radio frequency (RF) carrier signal to a receiver module 204. The RF signal is mixed with a local oscillator signal contained within the receiver module 204. The receiver module 204 generates a recovered signal suitable for processing by a decoder 206 in a manner well known to those skilled in the art. The decoder 206 processes the received signal to decode an address. A controller 212 compares the decoded address with one or more predetermined addresses contained in a memory 208. When the addresses are substantially similar, the user is alerted that a signal has been received either by an audio alert (e.g., a speaker or transducer) 214 or a tactile alert (e.g., a vibrator) 216. Also, if the wrist watch pager 100 includes an optional voice output 220, recovered audio components of the received RF signal may be stored in the memory 208 for subsequent presentation by an output module 220. For non-voice messages, an output module 210 will automatically, or when manually selected by controls 218, presents the message, such as, by displaying the message on a display.

The wrist watch pager 100 is powered by a rechargeable battery 234 that is coupled a charging circuit 250 also contained within the housing 108. The terminals 238A and 238B provide power from the rechargeable battery 234 to wrist watch pager 100 by conventional techniques. The charging circuit 250 preferably includes a capacitor 240 (preferably, a 0.01 micro-Farad capacitance) and a capacitor 238 (preferably, a 0.2 micro-Farad capacitance) that provide an RF signal path to ground potential. A diode 236 provides a path for the charging current to reach the rechargeable battery 234 when the battery charger 120 is coupled to the antenna terminals 110A and 110B. The diode 236 also blocks a supply current from the rechargeable battery 234 from entering the receiver module 204. Additionally, the diode 236 prevents a short-circuit across the rechargeable battery 234 when the first and second clasps 110A and 110B are closed. A radio frequency (RF) choke 232 (preferably, a 1.0 mHenry inductance) blocks the RF paging signal from entering the charging circuit 250. A capacitor 230 blocks the charging signal, preferably a direct current, from entering the receiver module 204. In this way, the paging signal that is received by the antenna is passed to the receiver module, while it is blocked from the charging circuit 250. Similarly, when the battery charger is coupled to the wrist watch pager, the charging current is blocked from entering the receiver module. Thus, the antenna provides a dual function to receive paging signals and charging signals. By this techniques, additional terminals are not needed to couple the battery charger to the wrist watch pager.

I claim:

1. A selective call receiver powered by a rechargeable battery, comprising:

an antenna having first and second antenna portions for receiving paging signals when the first and second portions are coupled together to form a loop antenna, said first and second antenna portions capable of receiving a charging voltage from a batter charger directly coupled to said first and second antenna portions when said first and second antenna portions are uncoupled thereby disabling the loop antenna;

receiving means coupled to the loop antenna for presenting an alert in response to the paging signals;

means coupled between the loop antenna and the receiving means for blocking the charging voltage from the receiving means; and means coupled between the loop antenna and the rechargeable battery for blocking the received paging signal from the rechargeable battery.

2. The selective call receiver according to claim 1 wherein the means coupled between the loop antenna and the receiving means comprises a capacitive coupling means.

3. The selective call receiver according to claim 1 wherein the first and second antenna portions are enclosed in first and second wrist straps for coupling the selective call receiver to a user.

4. In a selective call receiver having an antenna with first and second antenna portions capable of receiving paging signals when said first and second portions are coupled together to form a loop antenna, a method for charging a rechargeable power supply, comprising the steps of:

(a) uncoupling the first and second antenna portions coupled together to disable the loop antenna;

(b) coupling the first and second antenna portions to a battery charger for charging the rechargeable power supply coupled thereto;

(c) blocking paging signals from the rechargeable power supply;

(d) providing a charging signal to the rechargeable power supply; and (e) blocking the charging signal from a receiving circuit.

5. A wrist watch pager powered by a rechargeable battery, comprising:

a loop antenna disposed in first and second wrist straps of the wrist watch pager wherein the loop antenna including first and second antenna portions disposed therein for receiving a paging signal when said first and second wrist straps are coupled to form a loop, said first and second antenna portions capable of receiving a charging current from a battery charger directly coupled to said first and second antenna portions when said first and second antenna portions are uncoupled thereby disabling the loop antenna;

receiving means coupled to the loop antenna for presenting an alert in response to the paging signal;

capacitive coupling means coupled between the loop antenna and the receiving means for blocking the charging current from the receiving means; and inductive coupling means coupled between the loop antenna and the rechargeable battery for blocking the paging signal from the rechargeable battery. e

* * * * *

UNITED STATES PATENT AND TRADEMARK OFFICE

CERTIFICATE OF CORRECTION

PATENT NO. : 5,194,857

DATED : Mar. 16, 1993

INVENTOR(S) : Gomez

It is certified that error appears in the above-identified patent and that said Letters Patent is hereby corrected as shown below:

Column 3, line 28, delete "batter" and insert --battery--.

Column 4, line 42, after "battery." delete --e--.

Signed and Sealed this

Twenty-second Day of March, 1994

*Attest:*

*Attesting Officer*

Bruce Lehman

BRUCE LEHMAN

*Commissioner of Patents and Trademarks*